United States Patent [19]

Robinson

[11] Patent Number: 4,911,140

[45] Date of Patent: Mar. 27, 1990

[54] PORTABLE STOVE

[76] Inventor: Ken Robinson, General Delivery, Del Bonita, Alberta, Canada, T0K 0S0

[21] Appl. No.: 379,053

[22] Filed: Jul. 13, 1989

[30] Foreign Application Priority Data

Jul. 28, 1988 [CA] Canada ..... 573328

[51] Int. Cl.[4] ..... F24C 1/16

[52] U.S. Cl. ..... 126/59; 126/9 R

[58] Field of Search ..... 126/9 R, 9 B, 59

[56] References Cited

U.S. PATENT DOCUMENTS

| | | | |
|---|---|---|---|
| 1,419,600 | 6/1922 | Anderson . | |
| 1,955,147 | 4/1934 | Remington . | |
| 2,119,799 | 6/1938 | Sivey | 126/9 R |
| 2,129,371 | 9/1938 | Robinson . | |
| 2,756,738 | 7/1956 | Kratz . | |
| 2,922,414 | 1/1960 | Brender | 126/9 R |
| 3,049,071 | 8/1962 | Diack . | |
| 4,069,806 | 1/1978 | Landry . | |
| 4,204,516 | 5/1980 | Figura . | |

*Primary Examiner*—Carroll B. Dority

*Attorney, Agent, or Firm*—Adrian D. Battison; Stanely G. Ade; Murray E. Thrift

[57] ABSTRACT

A pack stove comprises a rectangular stove body formed by upper and lower stove portions each having a flat rectangular base and three upstanding side walls. The sidewalls of the upper stove portion have a plurality of tabs on the inner surface each defining a slot with the inner surface of the sidewall so that the upper edges of the sidewalls of the lower portion are seated within the slots to hold the stove portion apart. A front plate carries the loading door and a controlled air inlet and is attached to fill the open fourth side of the stove container by flanges around the periphery of the front portion. The legs of the stove are seated within sleeve members welded into the interior of the underside. The stove can be collapsed into one or two separate containers for transporting equipment. The stove construction is rugged and resistance to damage in vigorous handling.

10 Claims, 3 Drawing Sheets

PORTABLE STOVE

BACKGROUND OF THE INVENTION

This invention relates to a portable stove construction. Portable stoves of this type often known as Pack Stoves generally comprise metal box sections which are coupled together to form a container for the fuel, a stove pipe which is attached to the container and legs which support the container from the ground. In addition the container must have a suitable door arrangement through which fuel can be fed to feed the combustion within the stove and generally an adjustable air inlet for controlling the rate of combustion as required.

Examples of devices of this type are shown in U.S. Pat. Nos. 1,955,147 (Remington) and 4,069,806 (Landry). Both of these devices provide designs of this general type which can be collapsed for ready transportation but in both cases the devices provided are relatively delicate in their construction and hence can be damaged by the vigorous action which is used in transportation of the stove.

It is one object of the present invention, therefore, to provide an improved stove construction which is very robust in its construction and resistant to damage from rough handling.

According to the invention, therefore, there is provided a portable stove comprising a lower stove portion and an upper stove portion, each portion comprising a rectangular substantially flat plate having side walls upstanding therefrom along three sides thereof such that the upper stove portion can be inverted over the lower stove portion and assembled to form a container with edges of the side walls of the upper stove portion lying along and supported by the side walls of the lower stove portion, a plurality of separate tab members at spaced positions along the sidewalls of one of said upper and lower stove portions, each tab member being attached to the side wall and extending parallel thereto to define a slot for receiving the edge of the side wall of the other of the upper and lower stove portions, means defining a stove pipe opening in the upper stove portion, a plurality of sleeve members mounted inside the lower stove portion defining an open mouth facing downwardly therefrom each for receiving a respective one of a plurality of legs for supporting the assembled stove portions, and a front portion separate from the stove portions and defining a front plate including a hinged door for loading fuel into the assembled stove, said front portion including flange means at right angles to the front plate for bolting to the upper and lower stove portions.

The invention therefore provides improvements in the connection of the upper and lower stove portions so the connection is resistant to damage and can continue to operate effectively even after one or more edges of the stove portions is damaged by rough handling. Furthermore the leg construction is of a very simple robust nature which ensures that the legs themselves are very simple and resistant to damage and the connection to the lower stove portion provides only an opening visible on the outer surface of the lower stove portion with the remainder of the coupling being protected inside the lower stove portion thus very resistant to damage.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

The cook stove comprises an upper stove portion indicated at 10, a lower stove portion indicated at 11, a front stove portion indicated at 12, a stove pipe mounting plate 13 and four legs 14.

Figure 1:
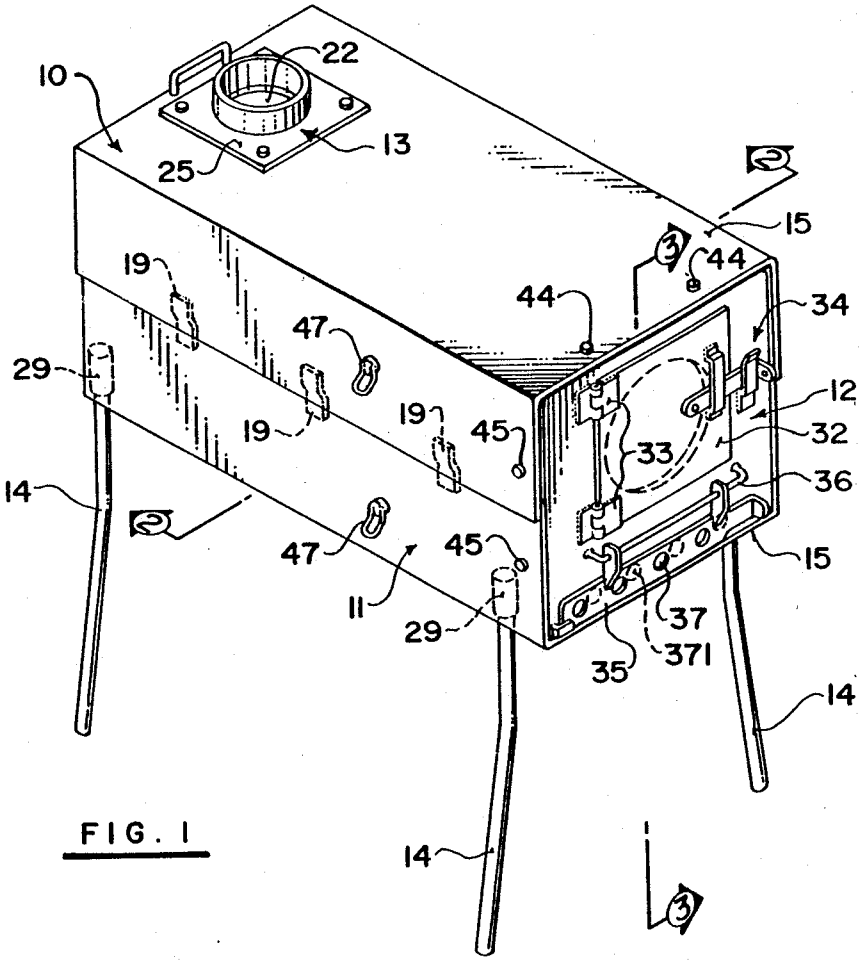
FIG. 1 is an isometric view of a portable camp stove according to the invention.

Each of the upper and lower stove portions comprises a flat rectangular plate 15 and three upstanding walls 16, 17 and 18 with the upper and lower portions being arranged to be substantially symmetrical so that, as shown in FIG. 1, the stove portions can be assembled together with the edges of the upper stove portion resting effectively on the upper edges of the lower stove portion to form a rectangular construction to receive the combustible materials.

The height of the side walls 16, 17 and 18 of the upper stove portion are substantially equal to the height of the sidewalls of the lower stove portion so that the dividing line is approximately half the height of the assembled stove.

On an inner face of the upper stove portion is provided a plurality of tab members 19 each of which is formed by a small plate of metal which has a tab base 20 welded to the inner surface of the sidewall and a tab support portion 21 cranked away from the surface of the sidewall to define therewith a slot for receiving the upper edge of the sidewall of the lower stove portion.

Figure 2:
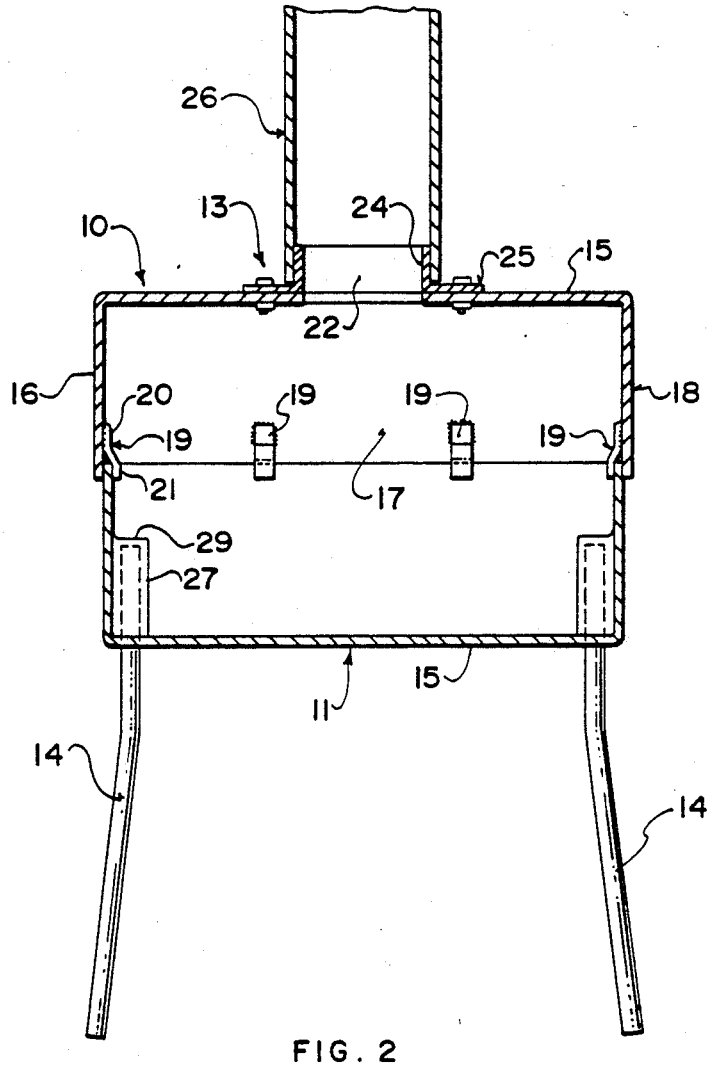
FIG. 2 is a cross sectional view along the lines 2—2 of FIG. 1.

As shown in FIG. 2 there are two such tab members on the rear side wall 17 and as shown in FIG. 1 there are three tab members along the longitudinal sidewalls 16 and 18. In this way the upper edge of the sidewalls of the lower stove portion are engaged within a number of slots defined by the separate tab members. If one tab member is deformed, it can be readily bent back to shape by application of a suitable tool. If one portion of the edge of the stove portions is again deformed, it is possible to insert the edges into the separate slots defined by the tab members simply by applying sufficient force to the stove portions to provide the necessary local deformation to engage the tab member. In some extreme cases, one or more tab members can be ignored or broken away without interfering with the proper connection between the upper and lower stove portions.

The flat plate of the upper stove portion is rectangular as best shown in FIG. 1 and is effectively closed apart from an opening 22 arranged approximately at a mid point across the width of the plate and at a position at the back of the plate closely adjacent the rear wall 17. The stove pipe mounting plate 13 is separate from the plate of the upper stove portion and includes a ring 24 and a base plate 25 so that the base plate 25 can be bolted to the plate 15 with the ring 24 upstanding therefrom and surrounding the opening 22. A flue pipe 26 can be engaged onto the outer surface of the ring 24 so as to extend upwardly from the ring and to act as a flue communicating combustion gases away from the combustion chamber defined inside the upper and lower stove portions.

The lower stove portion 11 similarly includes a flat base 15 which is substantially wholly closed. At each of the four corners of the plate 15 is provided a sleeve member 27 which is welded to the upper surface of the plate 15 so as to define an open mouth of the sleeve member indicated at 28 which breaks out onto an underside of the plate 15 with the sleeve member extending vertically upwardly therefrom. The sleeve member has a closed end 29 so that it can locate the end of one of the legs 14 which is suitably formed with an outer diameter which is a sliding fit within the inner diameter of the sleeve member 27. Each of the legs is formed from rod or pipe and may include a slight crank so that the leg extends outwardly from the crank to provide additional stability by increasing the dimension of the base on which the stove stands.

The front portion 12 comprises a rectangular plate of a dimension such that it completes the open fourth side of both of the upper stove portion and the lower stove portion. The front plate indicated at 30 has a first fuel loading opening 31 and a plurality of air openings 371 beneath the fuel opening. The fuel opening is arranged adjacent the upper edge of the plate 30 and is of sufficient size so that the fuel can be loaded readily into the stove through the opening without the necessity for further openings in the cook surface defined by the upper stove portion. The fuel loading opening 31 is closed by a door 32 mounted on hinges 33 and latched by a suitable latch arrangement indicated at 34. The air opening 371 can be opened and closed by a plate 35 which slides along a bar 36 and contains a plurality of openings 37 which can be moved to a position directly overlying the openings 32 to allow maximum air flow to a position fully closing the openings 32 or a position therebetween thus regulating the amount of airflow into the combustion chamber.

Figure 3:
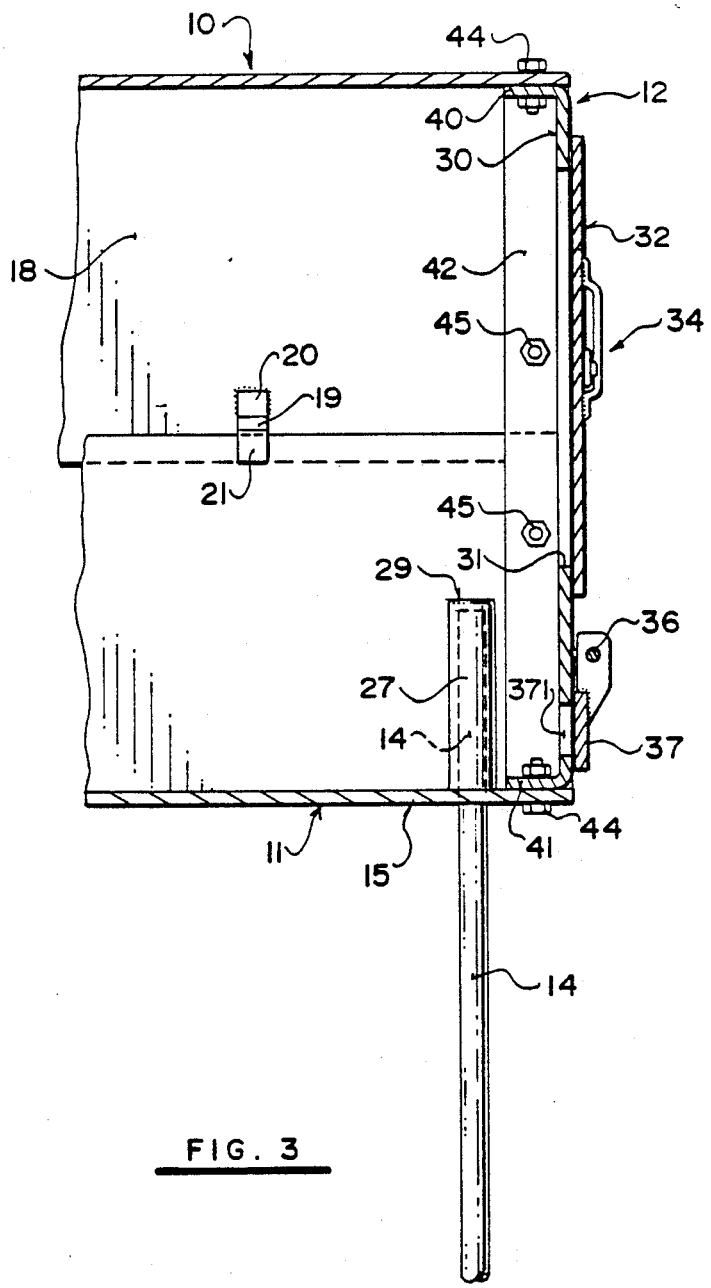
FIG. 3 is a cross sectional view along the lines 3—3 of FIG. 1.

The front plate 30 has upper and lower flanges 40 and 41 turned back at right angles to the front plate. Similarly right angle side flanges are provided one of which is visible in FIG. 3 at 42. The upper and lower flanges are bolted to the flat plate of the upper and lower stove portions respectively by bolts 44. The side flanges 42 are bolted by bolts 45 to the sidewalls of the upper and lower stove portions respectively so that the front plate and its attachment to the upper and lower stove portions acts to integrate the whole construction into a completed device resistant to deformation or collapse.

Figure 4:
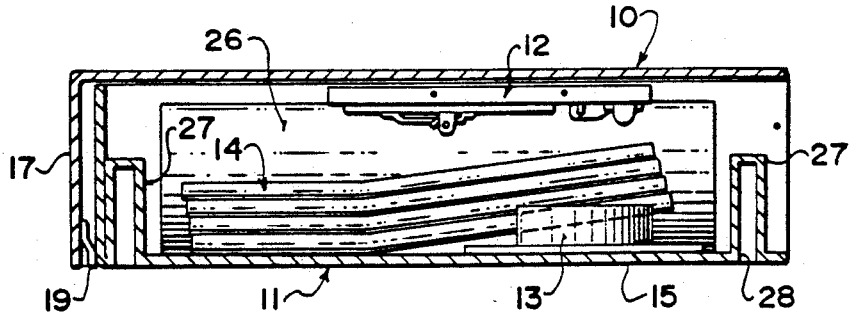
FIG. 4 is a cross sectional view of the parts of the cookstove of FIG. 1 in a collapsed condition for transporation.

As shown in FIG. 4, with the front portion 12 removed, the upper stove portion can be lifted slightly so that the tabs move away from the upper edge of the lower stove portion and then the lower stove portion can be pushed inside the upper stove portion. In this position, the stove pipe 26, pipe mounting bracket 13 and legs 14 can all be inserted inside the rectangular container thus formed which is approximately half the size of the combustion area of the stove when assembled. In addition the front portion 12 can be housed in the container so that the collapsed stove can be readily transported.

On an outer surface of each of the two longitudinal sidewalls of the upper and lower stove portions is mounted a loop member through which a rope can be passed in the condition of the device for strapping the collapsed container onto a suitable support. The use of the tube members 47 on each of the upper and lower stove portions enables each of these portions to be used as a separate container with a separate plate being used to close the open face of the container opposite to the base plate 15.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What is claimed:

1. A portable stove comprising a lower stove portion and an upper stove portion, each portion comprising a rectangular substantially flat plate having side walls upstanding therefrom along three sides thereof such that the upper stove portion can be inverted over the lower stove portion and assembled to form a container with edges of the side walls of the upper stove portion lying along and supported by the side walls of the lower stove portion, a plurality of separate tab members at spaced positions along the sidewalls of one of said upper and lower stove portions, each tab member being attached to the side wall and extending parallel thereto to define a slot for receiving the edge of the side wall of the other of the upper and lower stove portions, means defining a stove pipe opening in the upper stove portion, a plurality of sleeve members mounted inside the lower stove portion defining an open mouth facing downwardly therefrom each for receiving a respective one of a plurality of legs for supporting the assembled stove portions, and a front portion separate from the stove portions and defining a front plate including a hinged door for loading fuel into the assembled stove, said front portion including flange means at right angles to the front plate for bolting to the upper and lower stove portions.

2. The invention according to claim 1 wherein the sidewalls of the upper stove portion are substantially equal in height to the sidewalls of the lower stove portion such that the upper and lower stove portions can be nested so as to form a single rectangular container.

3. The invention according to claim 1 wherein the front portion includes means defining an air inlet and adjustable means for varying an effective air inlet cross sectional area thereof.

4. The invention according to claim 1 wherein the front portion defines a fourth side for each of the upper and lower stove portions such that an upper edge of the front portion engages the plate of the upper stove portion and a lower edge of the front portion engages the plate of the lower portion.

5. The invention according to claim 1 wherein the front portion defines a fourth side for each of the upper and lower stove portions such that an upper edge of the front portion engages the plate of the upper stove portion and a lower edge of the front portion engages the plate of the lower portion, said front portion being bolted to both the plate of the upper stove portion and the plate of the lower stove portion.

6. The invention according to claim 1 wherein each of sidewalls of said one of said upper and lower stove portions includes at least one tab member thereon.

7. The invention according to claim 1 wherein said tab members are formed on an inner surface of the side walls.

8. The invention according to claim 1 wherein one of said stove portions includes a pair of loop members on an outer surface of two side walls thereof, said loop members being arranged to receive a rope for supporting of the stove portions.

9. The invention according to claim 1 including stove pipe mounting means comprising a ring and a plate member at one end of the ring and arranged at right angles to an axis of the ring, the plate member being arranged for bolting to said upper stove portion at said stove pipe opening.

10. The invention according to claim 1 including stove pipe mounting means comprising a ring and a plate member at one end of the ring and arranged at right angles to an axis of the ring, the plate member being arranged for bolting to said upper stove portion at said stove pipe opening, and including stove pipe means for mounting on said ring, said stove pipe mounting means and said stove pipe being storable within an area defined by the side walls and the plate member of one of said upper and lower stove portions.

* * * * *